US012751596B2

(12) United States Patent
Huang et al.

(10) Patent No.: US 12,751,596 B2
(45) Date of Patent: Oct. 6, 2026

(54) CLEANING APPARATUS

(71) Applicant: SUZHOU EUP ELECTRIC CO. LTD., Suzhou (CN)

(72) Inventors: Yuyuan Huang, Suzhou (CN); Zhuang Bian, Suzhou (CN)

(73) Assignee: SUZHOU EUP ELECTRIC CO. LTD., Suzhou (CN)

( * ) Notice: Subject to any disclaimer, the term of this patent is extended or adjusted under 35 U.S.C. 154(b) by 363 days.

(21) Appl. No.: 18/681,043

(22) PCT Filed: Apr. 6, 2022

(86) PCT No.: PCT/CN2022/085309

§ 371 (c)(1),
(2) Date: Feb. 3, 2024

(87) PCT Pub. No.: WO2023/019968

PCT Pub. Date: Feb. 23, 2023

(65) Prior Publication Data

US 2024/0268619 A1 Aug. 15, 2024

(30) Foreign Application Priority Data

| | | |
|---|---|---|
| Aug. 20, 2021 | (CN) | 202110959195.2 |
| Jan. 29, 2022 | (CN) | 202210111561.3 |
| Jan. 29, 2022 | (CN) | 202220245871.X |

(51) Int. Cl.
*A47L 11/30* (2006.01)
*A46B 13/00* (2006.01)
(Continued)

(52) U.S. Cl.
CPC ..... *A47L 11/302* (2013.01); *A46B 13/001* (2013.01); *A46B 13/04* (2013.01);
(Continued)

(58) Field of Classification Search
CPC .... A47L 7/0004; A47L 7/0014; A47L 7/0019; A47L 11/30; A47L 11/34; A47L 11/4041; A47L 5/225
(Continued)

(56) References Cited

U.S. PATENT DOCUMENTS

| | | | | |
|---|---|---|---|---|
| 11,019,976 | B1 * | 6/2021 | Hangyu | A47L 11/4013 |
| 2018/0055301 | A1 | 3/2018 | Conrad et al. | |

(Continued)

FOREIGN PATENT DOCUMENTS

| | | |
|---|---|---|
| CN | 202699035 U | 1/2013 |
| CN | 106413497 A | 2/2017 |

(Continued)

OTHER PUBLICATIONS

Transation of KR20030029245A (Year: 2003).*

*Primary Examiner* — Tom Rodgers
(74) *Attorney, Agent, or Firm* — SZDC Law PC

(57) ABSTRACT

A cleaning apparatus (100) comprises a cleaning base (1) having a brush roll (12), a cleaning fluid dispenser (14), a suction nozzle (13), and a brush-roll motor, a lower portion (21) of a manipulating shaft (2) pivotally coupled to the cleaning base (1), a portable cleaner body (3) removably mounted to the manipulating shaft (2), and a suction extension hose (4) capable of being adapted for use with the portable cleaner body (3). The portable cleaner body (3) is selectively engaged with the manipulating shaft (2) or the suction extension hose (4) to obtain a plurality of modes of operation.

17 Claims, 17 Drawing Sheets

(51) Int. Cl.
*A46B 13/04* (2006.01)
*A47L 11/40* (2006.01)

(52) U.S. Cl.
CPC ..... *A47L 11/4005* (2013.01); *A47L 11/4008* (2013.01); *A47L 11/4016* (2013.01); *A47L 11/4041* (2013.01); *A47L 11/4044* (2013.01); *A47L 11/4069* (2013.01); *A47L 11/4075* (2013.01); *A47L 11/4083* (2013.01); *A47L 11/4088* (2013.01); *A46B 2200/3033* (2013.01)

(58) Field of Classification Search
USPC ..... 15/320
See application file for complete search history.

(56) References Cited

U.S. PATENT DOCUMENTS

| | | | | |
|---|---|---|---|---|
| 2021/0186283 | A1* | 6/2021 | Nguyen | A47L 9/30 |
| 2022/0322896 | A1* | 10/2022 | Lhoste-Clos | A47L 9/0411 |

FOREIGN PATENT DOCUMENTS

| | | | | |
|---|---|---|---|---|
| CN | 107105951 | A | | 8/2017 |
| CN | 206365853 | U | | 8/2017 |
| CN | 110367874 | A | | 10/2019 |
| CN | 112367889 | A | | 2/2021 |
| KR | 20030029245 | A | * | 4/2003 |

* cited by examiner

CLEANING APPARATUS

CROSS-REFERENCE TO RELATED APPLICATIONS

This application is the National Stage Application of PCT/CN2022/085309, filed on Apr. 6, 2022, claims the priority of Chinese Patent Application No. CN202110959195.2, filed on Aug. 20, 2021, entitled "Surface cleaning apparatus"; Chinese Patent Application No. CN202210111561.3, filed on Jan. 28, 2022, entitled "Surface cleaning apparatus"; and Chinese Patent Application No. CN202220245871.X, filed on Jan. 28, 2022, entitled "Suction hose for surface cleaning apparatus"; the disclosure of which are incorporated by reference herein.

TECHNICAL FIELD

The present application relates to the field of surface cleaning apparatus, and more particularly to a cleaning apparatus capable of cleaning surfaces using a cleaning liquid and recycling the used cleaning liquid.

BACKGROUND OF THE INVENTION

Cleaning apparatus, especially vertical surface cleaning apparatus, cleans and vacuums the surface to be cleaned by utilizing a cleaning base with a brush roll. During the operation of such apparatus, the cleaning liquid is applied to the surface to be cleaned by the rotating brush roll, which, together with the suction power of the suction unit, are also able to pick up the dirt and debris from the floor to be cleaned and deposit them in the recovery tank on the vertical body.

The advantages of the above type of apparatus are obvious when cleaning general floor surfaces; however, when encountering surfaces in low places 1 or surfaces on higher ground, such as table tops, higher parts of the wall, the bottom of tables, the bottom of sofas, and other special areas, it is not possible to utilize the apparatus to continue to clean these special areas due to the weight of the body and the limitations of the backward rotating angle (the reason is that when the body is turned over at too large of an angle, then the soiled liquid in the recovery tank will be backed up to the suction device, resulting in the damage of the suction device), the apparatus could not continue to clean these special areas. In order to ensure that these special areas can also be properly cleaned, the operator needs to additionally prepare different types of cleaning apparatus or tools for cleaning, which greatly reduces the cleaning efficiency of the cleaning apparatus; and multiple changes of cleaning tools can be troublesome for the operator.

BRIEF SUMMARY OF THE INVENTION

In order to solve the technical problem that the above cleaning apparatus is limited in use situations, it is an object of the present application to provide a cleaning apparatus that can be easily combined by an operator on demand to be adapted to be used in a wide range of workplaces.

In order to realize the above object, the present application provides a cleaning apparatus, comprising: a cleaning base comprising a brush roll capable of contacting a surface to be cleaned, a cleaning fluid dispenser for dispensing cleaning fluid to the brush roll and/or the surface to be cleaned, a suction nozzle and a brush-roll motor for driving the brush roll in rotation; a manipulating shaft, a lower portion of which is rotatably coupled to the cleaning base, an upper portion of the manipulating shaft is provided with a first handle, the manipulating shaft including a first engagement portion provided with a first port in fluid communication with the suction nozzle, a second port in fluid communication with the cleaning solution dispenser, and a first electrical connection terminal in electrical communication with the brush-roll motor; a portable cleaner body removably installed on the manipulating shaft and including a supply tank for storing cleaning liquid, a recovery tank for storing dirty liquid, a fluid connection with the recovery tank a suction motor, a second handle for the user to carry the portable cleaner body, a battery pack, and a second engagement portion providing a third port in fluid communication with the recovery tank, a fourth port in fluid communication with the supply tank, and a second electrical connection terminal in electrical conduction with the battery pack; wherein the second engagement portion is configured to be capable of coupling with the first engagement portion to fluidly connect the third port to the first port, the fourth port to the second port, and the second electrical connection terminal to the first electrical connection terminal; and a suction extension hose set independently of the manipulating shaft and the portable cleaner body and having a first end portion and a second end portion far from each other in the length direction, and the suction extension hose providing a first fluid pathway, a second fluid pathway, and an electrical circuit located between the first end portion and the second end portion; wherein the second end portion is constructed to be capable of coupling with the second engagement portion to electrically connect the first fluid pathway to the third port fluidly, the second fluid pathway to the fourth port fluidly, and the electrical circuit to the second electrical connection terminal.

In the above-mentioned technical solution of the present invention, it is favorable if the portable cleaner body is detachably supported on the front side of the manipulating shaft.

In the above-mentioned technical solution of the present invention, it is favorable if the manipulating shaft comprises a sloped surface, and the first port, the second port, and the first electrical connection terminal are distributed on the sloped surface. Further preferably, the first electrical connection terminal, the second port, and the first port are distributed from top to bottom.

In the above-mentioned technical solution of the present invention, optionally, the recovery tank has a bottom end, a top end opposite to the bottom end, and a side wall extending from the bottom end toward the top end. An interior of the recovery tank defined by the recovery chamber has an inlet tube leading to the chamber, the inlet tube inclined to a vertical plane having a lower port located on the side wall and an upper port extending into the chamber, and the third port is in fluid communication with or defined by the lower port.

In the above-mentioned technical solution of the present invention, optionally, the side wall has a recessed portion, and the lower port is located at the recessed portion.

In the above-mentioned technical solution of the present invention, optionally, the portable cleaner body includes a housing, the recovery tank and the supply tank are both removably mounted to the housing. The recovery tank is located directly below the suction motor, and the supply tank and the battery pack are located on the left and right sides of the recovery tank, respectively.

In the above-mentioned technical solution of the present invention, optionally, the second handle is fixedly provided on the top of the housing.

In the above-mentioned technical solution of the present invention, optionally, the portable cleaner body also includes a pump for outputting cleaning fluid from the supply tank outwardly.

In the above-mentioned technical solution of the present invention, optionally, the first handle is provided with a first control component for user operation, the second handle is provided with a second control component for user operation. The first control section has a first control button and a second control button for controlling the operation of the suction motor and the pump when the portable cleaner body is supported on the manipulating shaft, and the second control component has a third control button for controlling the operation of the suction motor when the portable cleaner body is removed from the manipulating shaft.

In the above-mentioned technical solution of the present invention, optionally, the suction extension hose has a fourth control button for controlling the operation of the pump when the second end portion is coupled with the second engagement portion.

In the above-mentioned technical solution of the present invention, optionally, the portable cleaner body includes a receiving cavity provided in the housing to receive the recovery tank, and the receiving cavity has a front portion with an opening to enable the recovery tank s to be placed into the receiving cavity from the front.

In the above-mentioned technical solution of the present invention, optionally, the housing has a bottom wall and a vertical wall extending upwardly from the bottom wall, and the receiving cavity is at least partially defined by the vertical wall and the bottom wall.

In the above-mentioned technical solution of the present invention, optionally, the housing has an exhaust hole in fluid communication with the suction motor, and the exhaust hole is located on the vertical wall and in fluid communication with the receiving cavity.

In the above-mentioned technical solution of the present invention, optionally, the bottom wall has a first support portion and a second support portion located on the right and left sides of the vertical wall, one part of the supply tank and the battery pack is provided on the first support portion and the other part is provided on the second support portion.

In the above-mentioned technical solution of the present invention, optionally, the first end portion has an outer end surface configured to seal against a flat surface, an interior of the first end portion defines a first chamber and a second chamber. The first chamber and the second chamber are in fluid communication with each other, and the first chamber has an opening located in the outer wall of the first end portion that allows outside air to flow into the first chamber. The first fluid pathway has a fluid connection provided at the first end and located within the first chamber, and the second fluid pathway has an airflow connection provided at the first end and located within the second chamber.

In the above-mentioned technical solution of the present invention, optionally, an interior of the first end portion has an axially extending wall. The first chamber and the second chamber are disposed on opposite sides of the wall, and the wall has a top surface disposed inwardly of the outer end surface. A notch is defined between the top surface and the outer end surface, and the first chamber and the second chamber are fluidly connected via the notch.

In the above-mentioned technical solution of the present invention, optionally, the cleaning apparatus further comprises: a plurality of cleaning tools adapted to contact the surface to be cleaned, wherein the plurality of cleaning tools are configured to be capable of coupling with the first end of the suction extension hose.

In the above-mentioned technical solution of the present invention, optionally, the cleaning apparatus comprises a plurality of modes of operation, the plurality of modes of operation comprising: a manipulating shaft operating mode in which the portable cleaner body is mounted to the manipulating shaft, and the first engagement portion coupled to the second engagement portion; and a first hand-held operating mode in which the portable cleaner body is detached from the manipulating shaft, the second end portion of the suction extension hose is coupled to the second engagement portion, and the first end portion of the suction extension hose is coupled to one of the cleaning tools.

In the above-mentioned technical solution of the present invention, optionally, the first end portion is constructed to be adapted to the first engagement portion and the plurality of modes of operation further comprising: a second hand-held operating mode in which the portable cleaner body is removed from the manipulating shaft, the second end portion of the suction extension hose is coupled to the second engagement portion, and the first end portion of the suction extension hose is engaged with the first engagement portion.

In the technical embodiment of the present application, when the operators carry out the cleaning surface operation, they can selectively utilize the cleaning base or the suction extension hose to extract the dirt and the dirty liquid. It can effectively expand the places where the cleaning apparatus can be used and to improve the cleaning efficiency.

Additional aspects and other advantages of the present application will be given in the following description section, in part as will become apparent from the following description, or as will be learned through the practice of the present invention.

BRIEF DESCRIPTION OF THE DRAWINGS

The present application will now be described with reference to the accompanying drawings, wherein.

DETAILED DESCRIPTION OF THE EMBODIMENTS

For the purpose of explaining in detail the technical contents, constructional features, purposes achieved and efficacy of the invention, the technical solutions in the embodiments of the present application will be described below in conjunction with the accompanying drawings in the embodiments of the present application, and it is clear that the embodiments described are only a portion of the embodiments of the present application and not all of the embodiments. In the following description, many specific details are set forth for explanatory purposes to provide a detailed description of various exemplary embodiments or implementations of the invention. However, various exemplary embodiments may also be implemented without these specific details or in one or more equivalent arrangements. Furthermore, the various exemplary embodiments may be different, but need not be exclusive. For example, specific shapes, configurations, and features of exemplary embodiments may be used or implemented in another exemplary embodiment without departing from the inventive concept.

Figure 1:
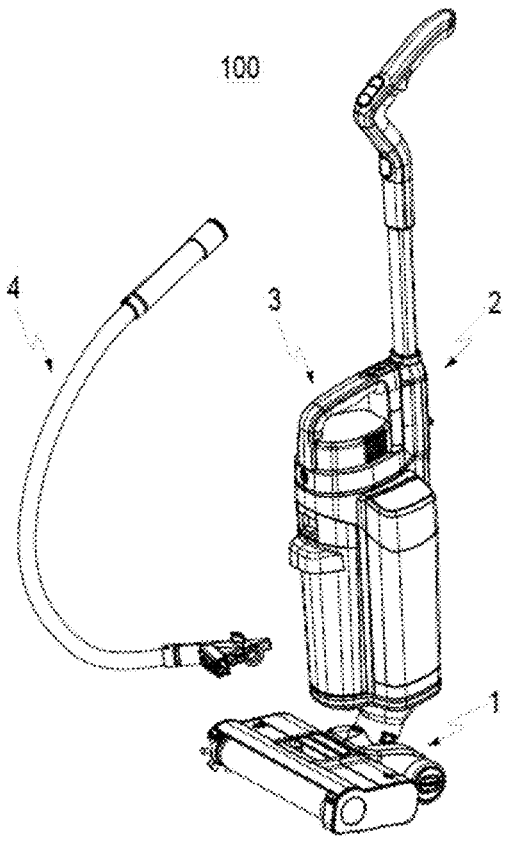
FIG. 1 is a schematic exploded view of a cleaning apparatus according to an embodiment provided in the present application.
Figure 2:
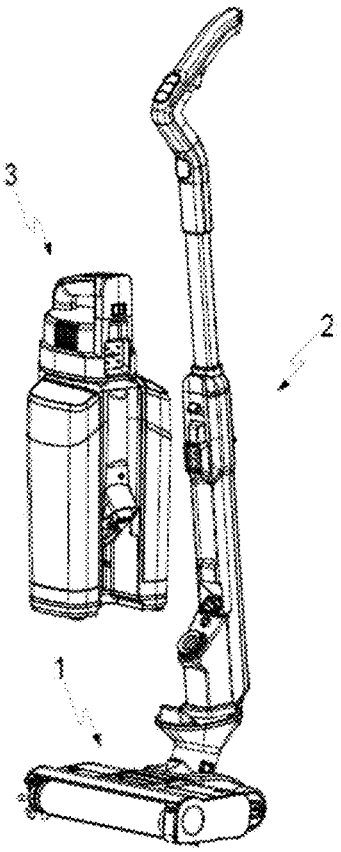
FIG. 2 is a schematic view of the cleaning base, the manipulating shaft and the portable cleaner body of FIG. 1 from another viewpoint.

FIG. 1 illustrates a cleaning apparatus 100 provided by an embodiment of the present application, which is capable of performing cleaning operations in multiple situations. The cleaning apparatus 100 comprises a cleaning base 1, a manipulating shaft 2, a portable cleaner body 3, and a suction extension hose 4. As shown in FIG. 2, the portable cleaner body 3 is removable from the manipulating shaft 2.

The azimuthal terms such as "up", "down", "front", "back", "left", "right", "vertical", and the like in the present application describing the relative positional relationship are based on the viewing angle when the portable cleaning main body 3 is mounted on the manipulating shaft 2 and the user pushes the cleaning apparatus 100 forward to carry out the cleaning operation.

Figure 3:
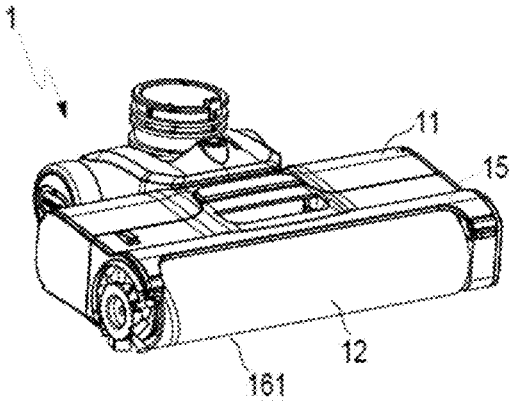
FIG. 3 is an exploded schematic view of the cleaning base with the top cover removed of FIG. 1.
Figure 4:
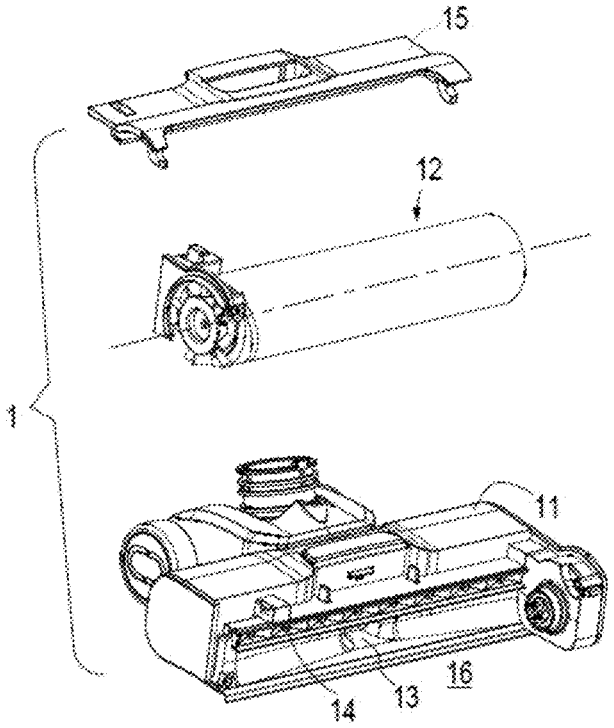
FIG. 4 is a schematic exploded view of a major portion of the cleaning base of FIG. 1.

As shown in FIGS. 3-4, the cleaning base 1 is adapted to move over a surface to be cleaned. It comprises a base housing 11 and a cover 15. The front part of the base housing 11 is provided with a brush roll 12, a suction nozzle 13 and a cleaning fluid dispenser 14. The cover 15 covers the upper part of the brush roll 12. In the example, the front part of the base housing 11 and the cover 15 define a brush chamber 16 with a lower opening 161 in which the brush roll 12 is placed and a lower part of the brush roll 12 protrudes downwardly from the opening 161. The suction nozzle 13 is located at the rear part of the brush chamber 16 and is in fluid communication with the brush chamber 16. A cleaning fluid dispenser 14 is arranged at the front side wall of the base housing 11 for dispensing a cleaning fluid to the brush roll 12. With the cleaning base 1 in operation, the cleaning fluid is continuously distributed via the cleaning fluid dispenser 14 to the brush roll 12, which brushes the surface to be cleaned. Debris on the surface to be cleaned, as well as dirt and fluid, will be picked up by the action of the suction nozzle 13 or by the combined action of the suction nozzle 13 and the brush roll 12. The brush roll 12 is driven to rotate by a brush-roll motor (not shown in the drawings) mounted at the rear of the base housing 11. The brush roll 12 in this case may be a brush roll with a rotation speed of hundreds of revolutions per minute or a brush roll with a rotation speed of thousands of revolutions, as long as it is able to meet the requirements for rubbing the floor with a cleaning solution.

Figure 5:
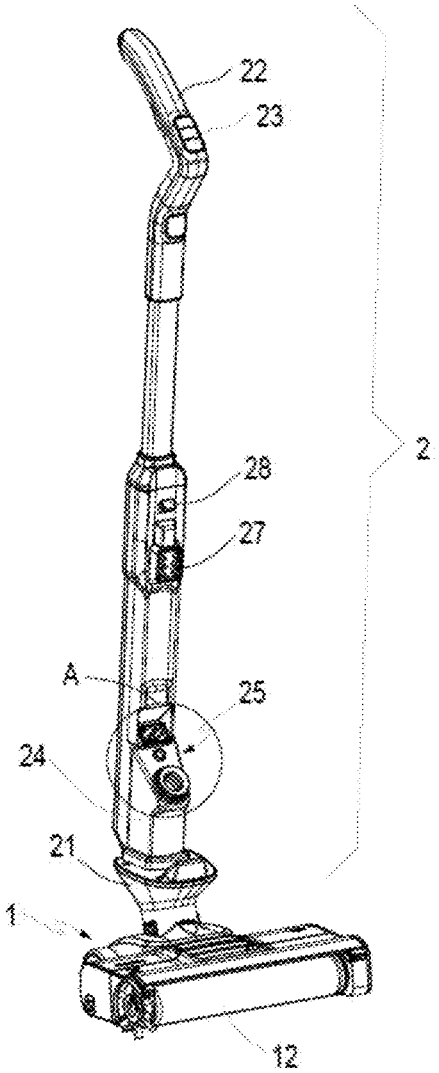
FIG. 5 is a schematic view of the cleaning base and the manipulating shaft shown in FIG. 1.

FIG. 5 illustrates a manipulating shaft 2 provided by an embodiment of the present application, which is of an elongated structure and extends in a vertical direction. A lower portion 21 of the manipulating shaft 2 is rotatably coupled to the base housing 11 of the cleaning base 1 between an upright storage position and an inclined working position. The upper portion of the manipulating shaft 2 is provided with a handle 22 for the user to hold. a number of control buttons 23 for controlling the operation of the cleaning apparatus 100 are provided on the handle 22; in other embodiments, these control buttons may also be provided at other locations of the cleaning apparatus 100, such as on the portable cleaner body 3. The manipulating shaft 2 is provided with a support platform 24 for supporting the portable cleaner body 3 near the lower portion 21, which is provided with an engagement portion 25 that constitutes a two-way fluid connection with the cleaning base 1 for the cleaning fluid and the dirt fluid, as well as an electrically conductive connection. The manipulating shaft 2 is also provided with a signal connecting terminal 27 and an operatively movable locking hook 28 located on the upper portion; when the portable cleaning main unit 3 is mounted on the manipulating shaft 2, the portable cleaner body 3 is provided with a signal connecting terminal 27 and a locking hook 28. In other embodiments, these control buttons may be provided on the cleaning apparatus 100, such as the portable cleaner body 3. The manipulating shaft 2, the portable cleaner body 3 will be secured to the manipulating shaft 2 by the locking hook 28 and the control circuit inside the portable cleaner body 3 will be signalized with the signal connection terminals 27.

Figure 6:
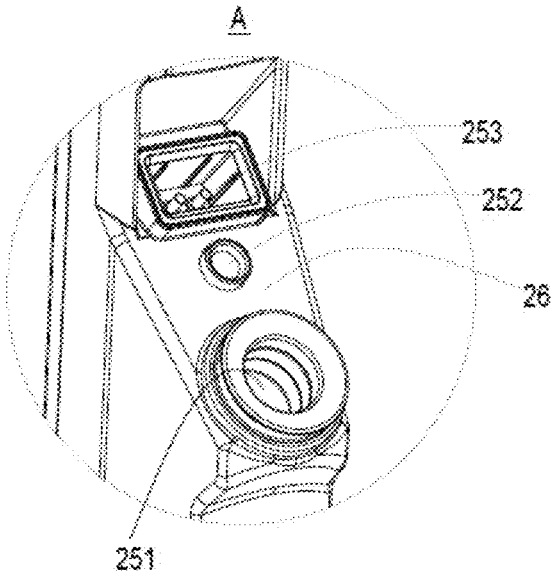
FIG. 6 is an enlarged schematic view of FIG. 5 at A.

As shown in FIG. 6, the top of the support platform 24 has a sloped surface 26 that gradually slopes toward the front and bottom, and the engagement portion 25 is located at the sloped surface 26. In this example, the engagement portion 25 provides a first port 251 in fluid communication with the suction nozzle 13, a second port 252 in fluid communication with the cleaning fluid dispenser 14, and a first electrical connection terminal 253 in electrical communication with the brush-roll motor.

Figure 7:
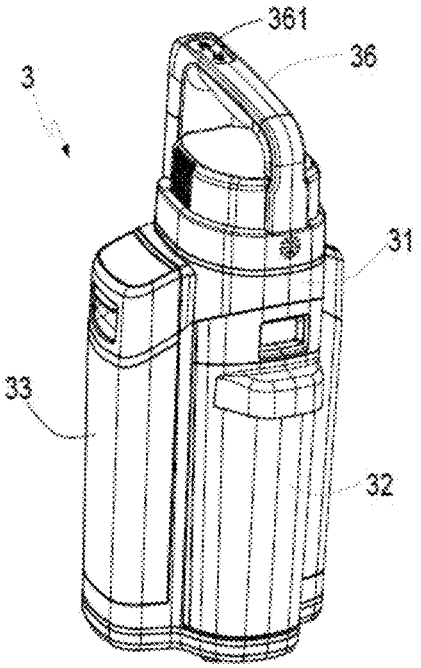
FIG. 7 is a perspective view of the portable cleaner body shown in FIG. 1, viewed from a front top view.
Figure 8:
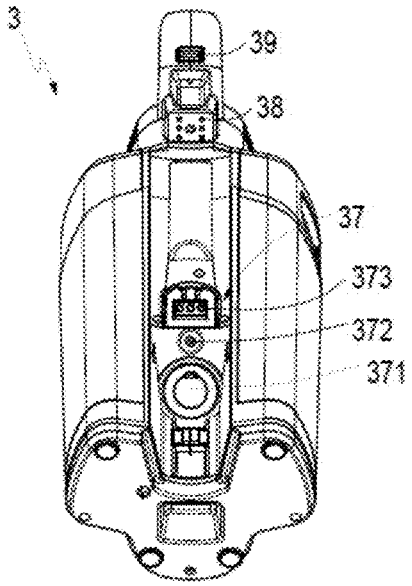
FIG. 8 is a perspective view of the portable cleaner body shown in FIG. 7 viewed from a rear lower view.
Figure 9:
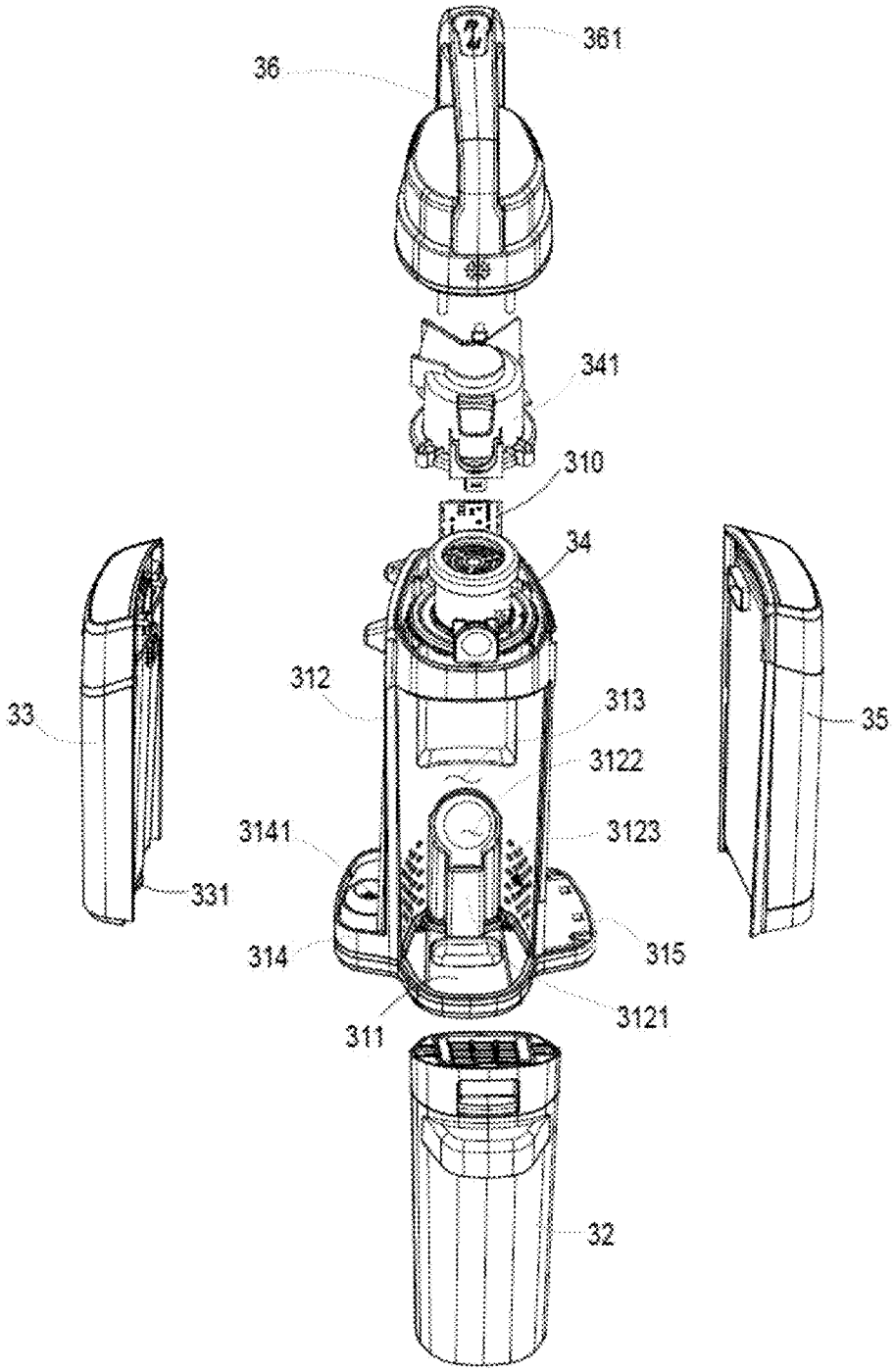
FIG. 9 is an exploded schematic view of the portable cleaner body shown in FIG. 7.

FIGS. 7-9 illustrate a portable cleaner body 3 provided by an embodiment of the present application, which mainly comprises a housing 31, a recovery tank 32 for accepting a dirty liquid, a supply tank 33 for storing a cleaning liquid, a suction motor 34, a battery pack 35, and a control board 310. A handle 36 is provided at the top of the housing 31 for the user to lift the portable cleaner body 3, and the handle 36 has a number of control buttons 361 at the top. By means of the handle 36, the user is able to lift the entire portable cleaner body 3. The recovery tank 32 and the supply tank 33 are both detachably provided on the housing 31. Locking mechanisms (not shown in the drawings) capable of being operated by the user are provided between the supply tank 33 and the housing 31, as well as between the recovery tank 32 and the housing 31. The Locking mechanisms may be mechanical locking assembly, a magnetic locking assembly, or both.

Continuing to FIG. 9, the housing 31 includes a bottom wall 311 and a vertical wall 312 extending upwardly from the bottom wall 311, the bottom wall 311 and the vertical wall 312 defining a receiving cavity 313 adapted to hold the recovery tank 32. The receiving cavity 313 has a front portion with an opening for the recovery tank 32 to be placed into. The bottom wall 311 also includes a first support portion 314 and a second support portion 315 located on the outer side of the vertical wall 312 and extending toward both sides, respectively. The first support portion 314 is capable of supporting the supply tank 33 thereon and the second support portion 315 is capable of supporting the battery pack 35 thereon. The first support portion 314 is provided with a port 3141 which mates with an outlet 331 of the supply tank 33. The suction motor 34, a motor cover 341, and the control board 310 are located in the upper inner portion of the housing 31. The lower rear portion of the vertical wall 312 is provided with a tab 3121, which is provided with an opening 3122 through the inside and outside of the receiving cavity 313. In the embodiment, the vertical wall 312 is a hollow double-wall structure, and a number of exhaust holes 3123 are provided on the inner wall thereof, which exhaust holes 3123 are connected to the airflow of the air outlet of the suction motor 34.

Referring to FIG. 8, the rear portion of the portable cleaner body 3 is provided with a lock slot 39, a signal connection terminal 38, and an engagement portion 37 disposed on the lower side of the signal connection terminal 38, in order from top to bottom. The engagement portion 37 is capable of engaging an engagement portion 25 on the manipulating shaft 2. The engagement portion 37 provides a third port 371 in fluid communication with the recovery tank 32, a fourth port 372 in fluid communication with the supply tank 33, and a second electrical connection terminal 373 in electrical conduction with the battery pack 35.

Figure 10:
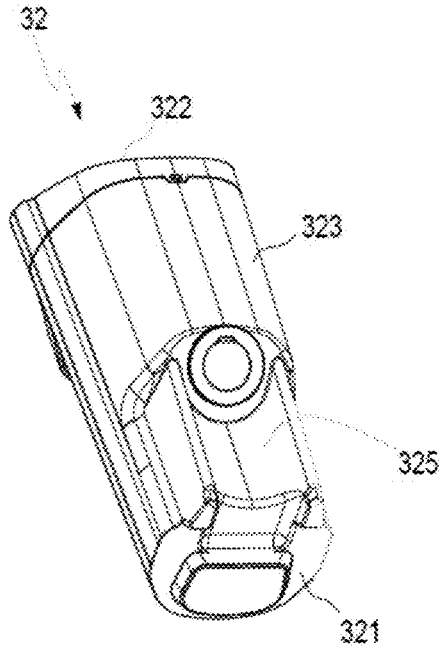
FIG. 10 is a perspective view of the recovery tank shown in FIG. 8 when viewed from a rear lower view
Figure 11:
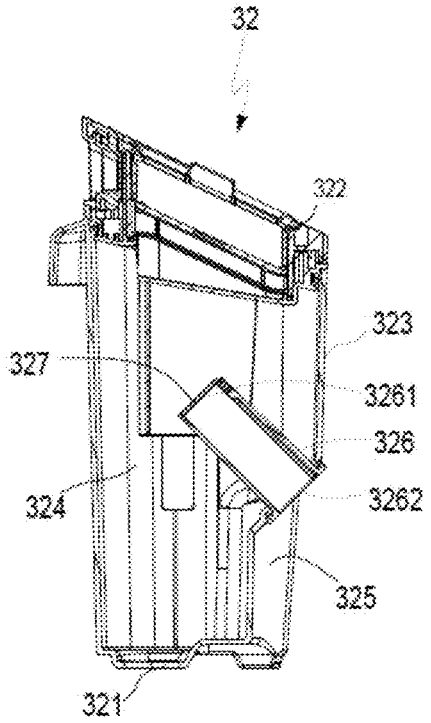
FIG. 11 is a cross-sectional illustration of the recovery tank shown in FIG. 10, taken along a vertical direction.

FIGS. 10-11 illustrate the recovery tank 32 provided by an embodiment of the present application. The recovery tank 32 includes a bottom end 321, a top end 322 opposite the bottom end 321 at an upward and downward angle, and a side wall 323 extending from the bottom end 321 toward the top end 322. The bottom end 321, the top end 322, and the side wall 323 together form the outer contour of the recovery tank 32 and define a recovery chamber 324 located inside the recovery tank 32. A portion of the side wall 323 proximate the bottom end 321 is recessed toward the interior of the dirt liquid recovery chamber 324 to form a recessed portion 325 that matches the tab 3121 of the vertical wall 312.

Continuing as shown in FIG. 11, the recovery tank 32 further includes an inlet tube 326 through the side wall 323. The inlet tube 326 is in fluid communication with the recovery chamber 324. The inlet tube 326 has a lower port 3262 formed at the top of the recessed portion 325 and an upper port 3261 that extends into the upper portion of the recovery chamber 324, wherein the lower port 3262 is exposed externally and the upper port 3261 is located on the front upper side of the lower port 3262. It will be appreciated that the inlet tube 326 is inclined relative to the vertical plane and gradually slopes upward and forward as it extends from the lower port 3262 to the upper port 3261. An interior of the recovery tank 32 is also provided with a one-way valve 327 located at the upper port 3261. The one-way valve 327 is used to block the upper port 3261. The one-way valve 327 is configured to open when the suction motor 34 is activated so that the upper port 3261 is in fluid communication with the recovery chamber 324; the one-way valve 327 automatically resets to close the upper port 3261 when the suction motor 34 is shut down.

Figure 12:
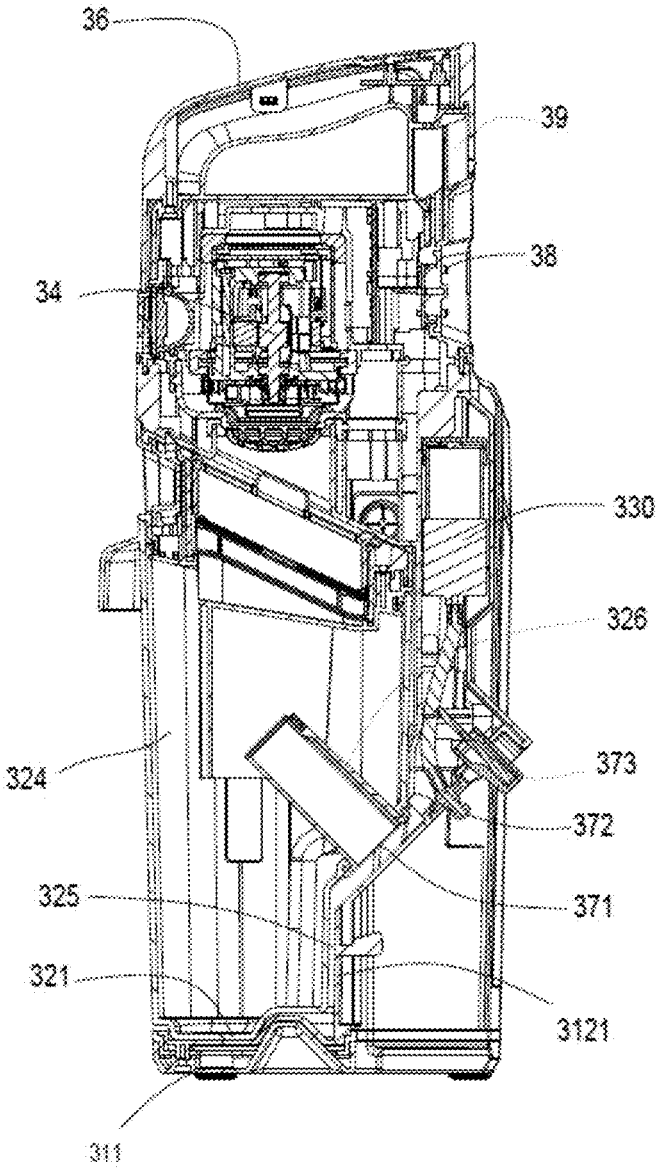
FIG. 12 is a cross-sectional illustration of the portable cleaner body shown in FIG. 7, taken along a vertical direction.

As shown in FIG. 12, when the recovery tank 32 is installed into the receiving cavity 313, the recessed portion 325 engages the tab 3121, and the lower port 3262 will be exposed from the opening 3122 and form the third port 371. The fourth port 372 and the second electrical connection terminal 373 are both exposed from the outer surface of the housing 31. The suction motor 34 is located on the upper side of the recovery tank 32 and the handle 36 is located on the top of the entire portable cleaner body 3. The housing 31 is also provided with a pump 330. The pump 330 will be located between the port 3141 and the fourth port 372 in order to deliver the cleaning liquid from the supply tank 33 to the fourth port 372. The lock slot 39 and the signal connection terminal 38 are located above the rear of the housing 11 and are exposed.

Figure 13:
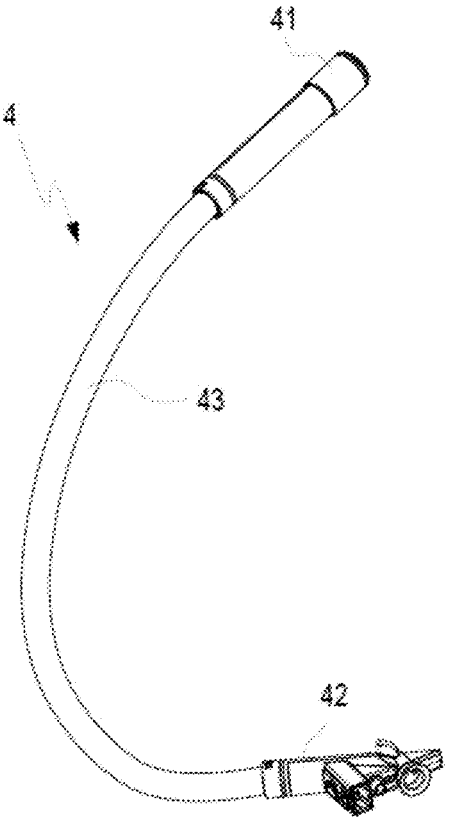
FIG. 13 is a schematic view of the suction extension hose shown in FIG. 1.

FIG. 13 illustrates a suction extension hose 4 provided by an embodiment of the present application, which is provided independently of the manipulating shaft 2 and the portable cleaner body 3. The suction extension hose 4 has a first end portion 41 and a second end portion 42 that are located away from each other in a lengthwise direction, and a flexible hose 43 located between the first end portion 41 and the second end portion 42. The first end portion 41 is capable of engaging a cleaning tool (e.g., the cleaning tool 5 shown in FIG. 20) that contacts the surface to be cleaned; the second end portion 42 is constructed to be adapted to fit into the engagement portion 37. After the second end portion 42 of the suction extension hose 4 is coupled to the engagement portion 37 on the portable cleaner body 3, the first end portion 41 is allowed to fold, deform, and so forth relative to the portable cleaner body 3.

Figure 14:
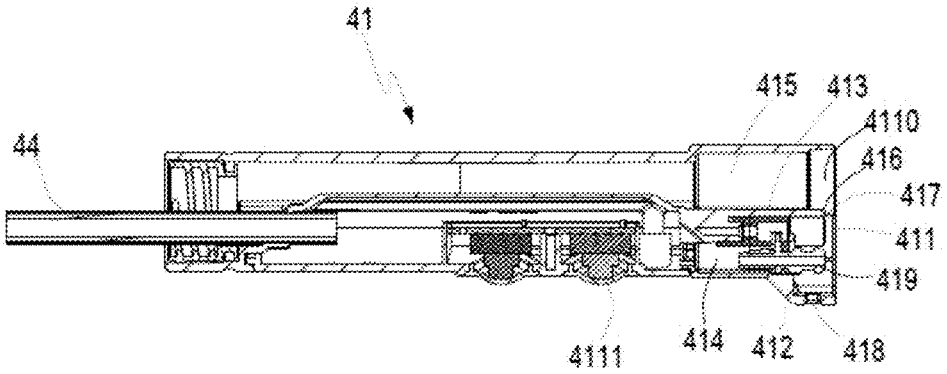
FIG. 14 is a cross-sectional illustration of the first end portion of the suction extension hose shown in FIG. 13, taken along a lengthwise direction.
Figure 17:
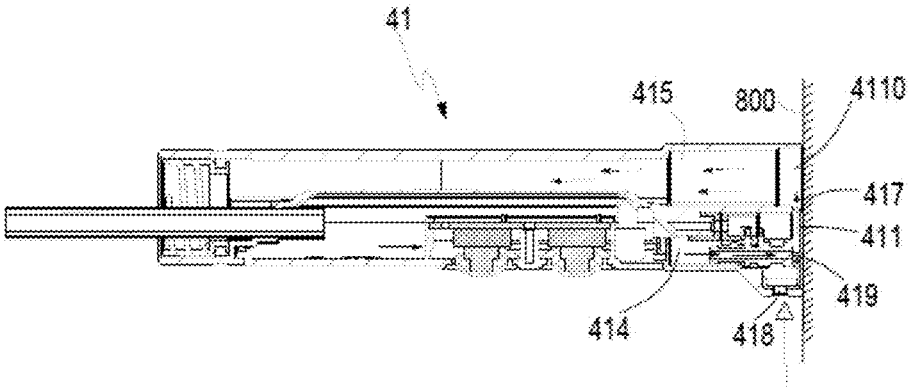
FIG. 17 is a schematic diagram of the direction of flow of cleaning liquid and air when the first end portion shown in FIG. 14 is resting against a plane.

FIG. 14 illustrates the structure of the first end portion 41. The first end portion 41 has an annular outer end surface 411, a protruding portion 412 formed by a portion of the circumferential surface extending outwardly, a wall 413 disposed internally and extending in a lengthwise direction, and a first chamber 414 and a second chamber 415 confined within the interior. A fluid connector 419 is provided in the first chamber 414, and the second chamber 415 has a connection port 4110 proximate the outer end surface 411. An electrical connection terminal 4111 is also provided on the first end 41. the outer end surface 411 is configured to seal against a flat surface (as shown in FIG. 17). The wall 413 has a top surface 416 disposed on the inside of the outer end surface 411, which together with the outer end surface 411 define a notch 417. The first chamber 414 and the second chamber 415 are located on each side of the wall 413 and are fluidly connected through the notches 417. The first chamber 414 has an opening 418 disposed on the protrusion 412. The opening 418 is configured to allow outside air to enter the first chamber 414; wherein the fluid connector 419 is closer to the outer end surface 411 than the opening 418 to prevent clean liquid flowing from the fluid connector 419 from leaking through the opening 418 to the outside of the suction extension hose 4.

Figure 15:
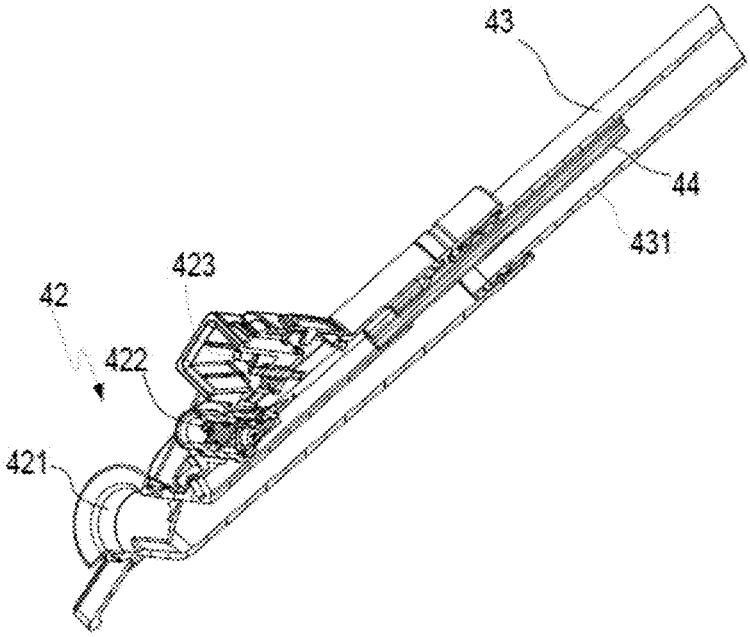
FIG. 15 is a cross-sectional illustration of the second end portion of the suction extension hose shown in FIG. 13, taken along a lengthwise direction.

FIG. 15 illustrates the construction of a second end portion 42. The second end portion 42 is constructed to be capable of engaging the engagement portion 37 of the portable cleaner body 3 to introduce of an external dirt-containing airflow into the portable cleaner body 3 via the suction extension hose 4. The second end portion 42 provides an airflow interface 421, a cleaning liquid interface 422, and an electrical connector 423. The positions and dimensions of the airflow interface 421, the cleaning liquid interface 422, and the electrical connector 423 are set such that, after the second end portion 42 is coupled to the engagement portion 37, the airflow interface 421 is in fluid communication with the third port 371 and the cleaning liquid interface 422 is in fluid communication with the fourth port 372.

Figure 16:
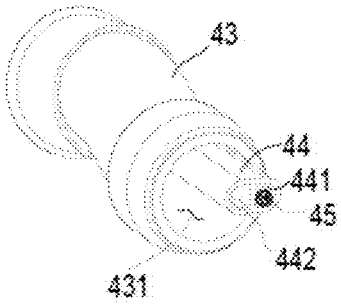
FIG. 16 is a schematic view of the interior of the flexible hose shown in FIG. 13.

As shown in FIG. 16, the flexible hose 43 is provided with a dual-channel tube 44 inside the flexible hose 43, which provides two pathways 441 and 442; the pathway 441 has an electrical wire 45 running through it, which will electrically connect the electrical connector 423 at the second end portion 42 to the electrical connection terminal 4111 at the first end portion 41 in order to form an electrically conductive pass-through pathway between the first end portion 41 and the second end portion 42 The pathway 442 fluidly connects the cleaning liquid interface 422 at the second end portion 42 to the fluid connector 419 at the first end portion 41 to form an output fluid pathway between the first end portion 41 and the second end portion 42. A channel 431 is formed inside the flexible hose 43, and the channel 431 fluidly connects the airflow interface 421 at the second end portion 42 to the connection port 4110 at the first end portion 41 so as to form a recovery fluid pathway between the first end portion 41 and the second end portion 42.

As shown in FIG. 17, the suction extension hose 4 of the present application is capable of simple self-cleaning. When the self-cleaning of the suction extension hose 4 is required, the second end portion 42 of the suction extension hose 4 is first coupled to the engagement portion 37 of the portable cleaner body 3, and then the outer end surface 411 of the first end portion 41 is attached to a plane 800; the pump 330 and the suction motor 34 on the portable cleaner body 3 are activated; the pump 330 conveys the cleaning liquid in the supply tank 33 to the fluid connector 419 of the suction extension hose 4; the suction motor 34 creates a negative pressure in the airflow path, and the cleaning liquid at the fluid connector 419 arrives at the connecting port 4110 of the second chamber 415 through the notch 417 and then flows through the recovery fluid pathway of the suction extension hose 4 under the effect of negative pressure by the suction motor 34 and finally arrives at and is stored in the recovery tank 32, thereby realizing flushing and cleaning of the entire recovery fluid pathway of the suction extension hose 4. During this process, outside air enters the first chamber 414 through the opening 418; this air will be drawn into the recovery fluid pathway along with fluid entrained to the fluid connector 419 flowing out of the first chamber 414 and cause the first chamber 414 to maintain a higher pressure than the second chamber 415.

In the use of portable cleaner body 3 and suction extension hose 4 work, the user can choose the appropriate type of cleaning tools according to the actual needs. As a result, the user can use the suction extension hose 4 to clean the surfaces; of course, in the process of using the suction extension hose 4 to clean, the user can also be replaced at any time according to the need for different types of cleaning tools; thus expanding the applicable cleaning area of the portable cleaner body 3 and improving the cleaning efficiency of the user.

The cleaning apparatus 100 of this embodiment has a plurality of modes of operation which include:

(1) A Manipulating Shaft Operating Mode

Figure 18:
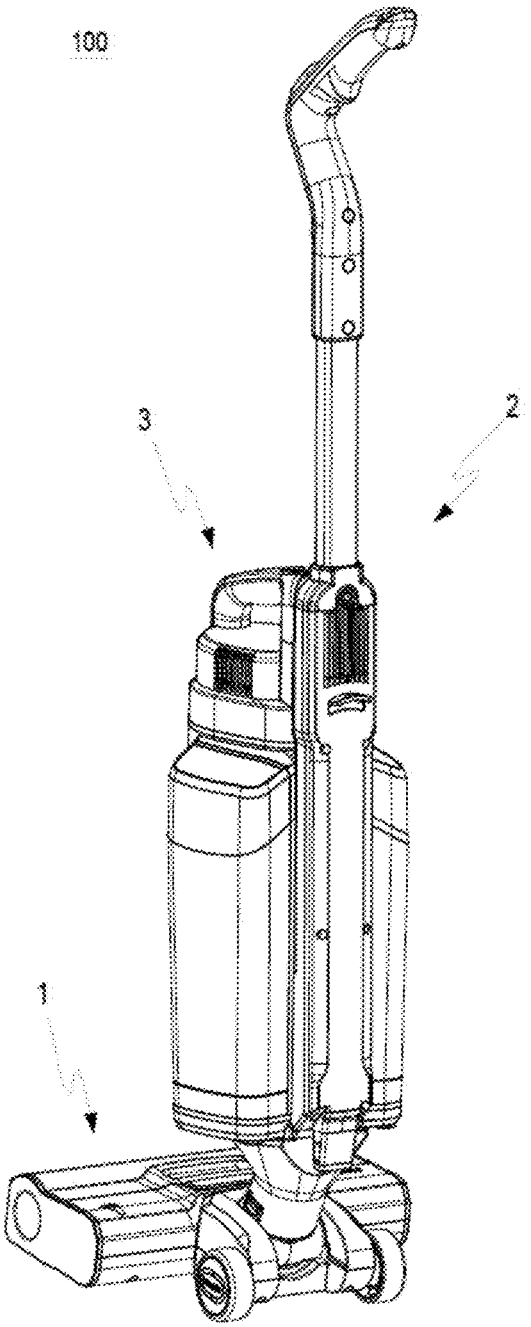
FIG. 18 illustrates a schematic view of the cleaning apparatus of FIG. 1 in the manipulating shaft operating mode.
Figure 19:
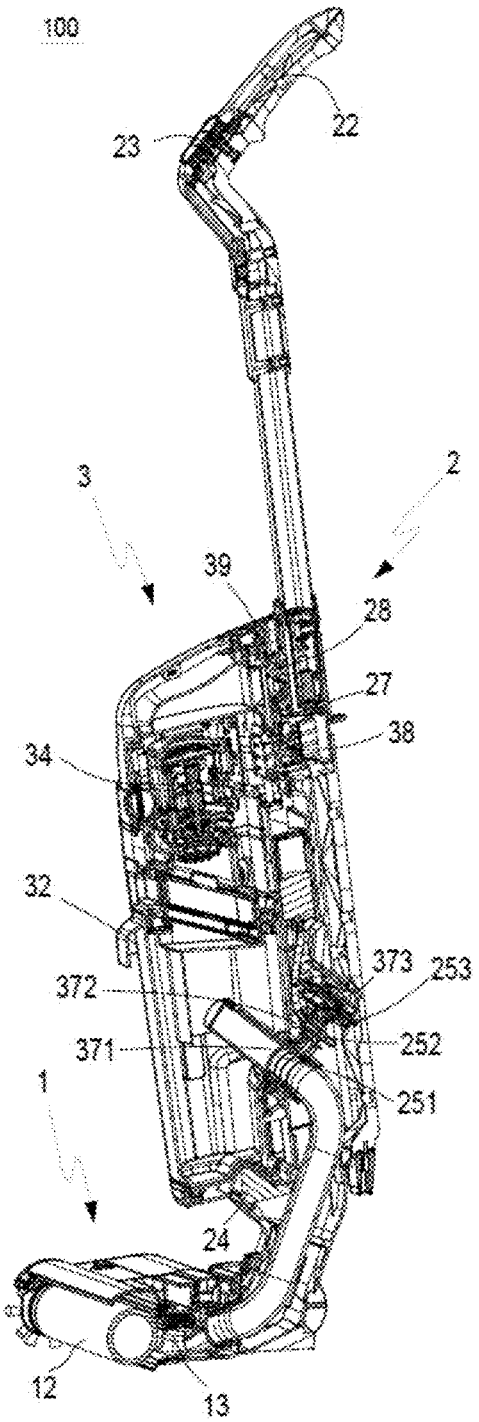
FIG. 19 illustrates cross-sectional illustration of the cleaning apparatus of FIG. 1 in the manipulating shaft operating mode.

As shown in FIGS. 18-19, the portable cleaner body 3 is mounted to the manipulating shaft 2 and locked together by the engagement of the lock hook 28 and the lock slot 39 in the manipulating shaft operating mode. The bottom of the portable cleaner body 3 will be supported on the support platform 24, and the engagement portion 25 on the manipulating shaft 2 engages the engagement portion 37 of the portable cleaner body 3. The user can hold the handle 22 to realize operating the cleaning apparatus 100 to work. The manipulating shaft 2 supported with the portable cleaner body 3 can be rotated relative to the cleaning base 1 between an upright position and an inclined working position. The suction nozzle 13, the first port 251 of the engagement portion 25, the third port 371 of the engagement portion 37, the recovery tank 32, and the suction motor 34 will be fluidly connected in turn; and the supply tank 33, the fourth port 372 of the engagement portion 37, the second port 252 of the engagement portion 25, and the cleaning fluid dispenser 14 will be fluidly connected in turn. The first electrical connection terminal 253 is electrically connected to the second electrical connection terminal 373. The signal connection terminal 38 is signalized to the signal connection terminal 27, which allows the user to control the operation of the apparatus via the control buttons 23.

The manipulating shaft operating mode is suitable for cleaning on open surfaces to be cleaned, such as the ground, etc.; when the apparatus is in operation, the cleaning liquid in the supply tank 33 is continuously supplied to the brush roll 12, and the brush roll 12 wetted by the cleaning solution is rotated under the drive of the brush-roll motor to continuously rub against the surface to be cleaned, thereby realizing the cleaning of the surface to be cleaned; at the same time, under the action of the suction motor 34, dirty liquid and debris on the surface to be cleaned and dirty liquid thrown off from the rotating brush roll 12 are sucked in together with the air by the suction nozzle 13 and sent to the recovery tank 32, the dirty liquid and the debris remain in the recovery tank 32, and the clean air is discharged to the outside world after the suction motor 34.

(2) A Hand-Held Operating Mode

Figure 20:
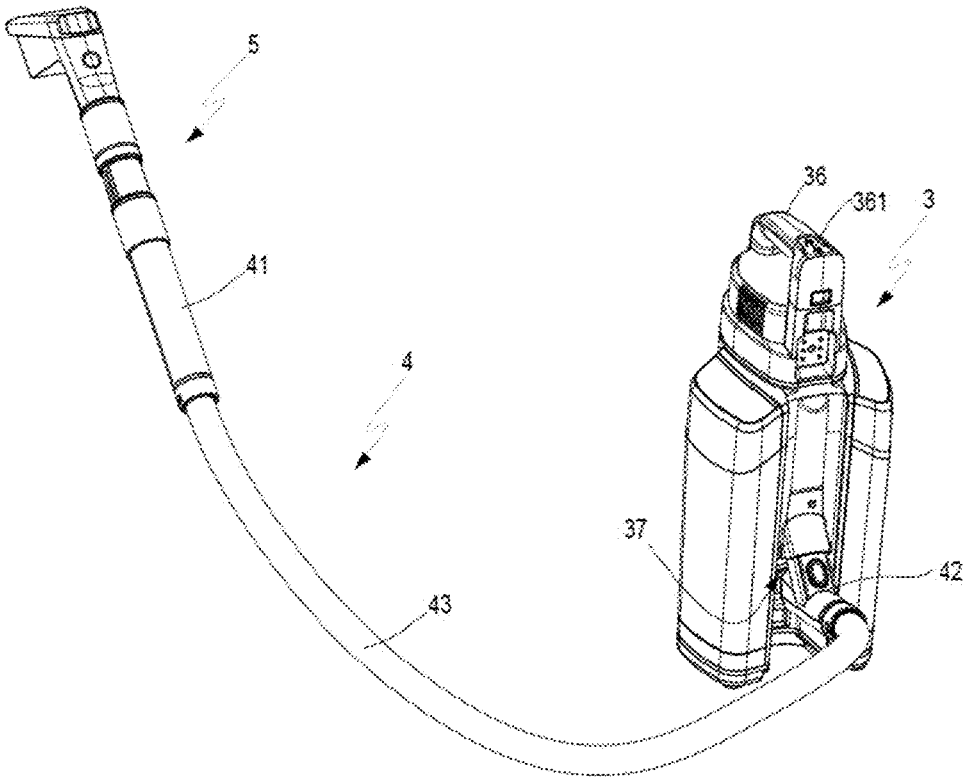
FIG. 20 illustrates a schematic cross-sectional view of the cleaning apparatus of FIG. 1 in the hand-held operating mode.

As shown in FIG. 20, in the hand-held operating mode, the portable cleaner body 3 is removed from the manipulating shaft 2, and the first end portion 41 of the suction extension hose 4 is engaged with a cleaning tool 5, and the second end portion 42 is engaged with the engagement portion 37 of the portable cleaner body 3. In this way, the connection port 4110, the channel 431, the airflow interface 421, the third port 371 of the engagement portion 37, the recovery tank 32, and the suction motor 34 will be fluidly connected in sequence. The supply tank 33, the fourth port 372 of the engagement portion 37, the cleaning liquid interface 422, the pathway 442, and the fluid connector 419 will be sequentially fluidly connected; the electrical connector 423 is electrically conductive to the second electrical connection terminal 373; and the user can manipulate the operation of the apparatus through the control buttons 361.

In the hand-held operating mode, the apparatus enables cleaning of areas further away from the portable cleaner body 3, such as the ability to clean non-floor cleaning surfaces, for example table tops, window panes, and the like. The cleaning tools can be changed as needed.

Figure 21:
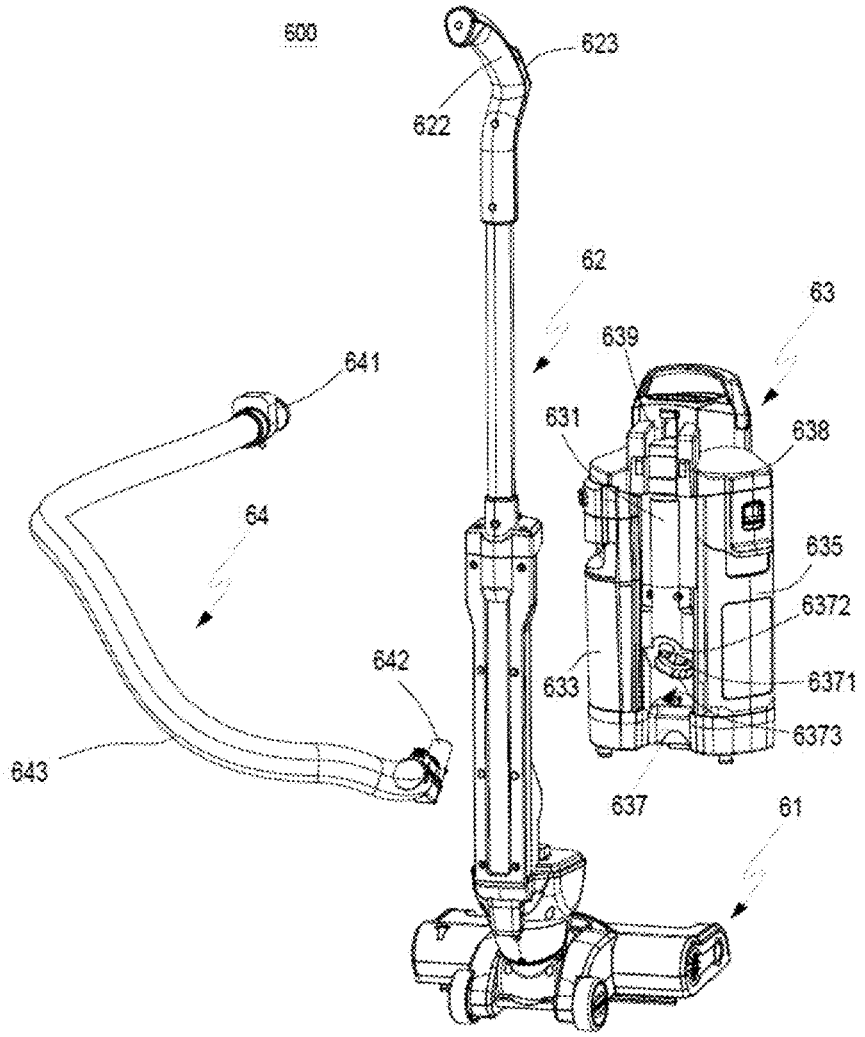
FIG. 21 is a schematic exploded view of a cleaning apparatus according to another embodiment provided in the present application.

FIG. 21 illustrates a cleaning apparatus 600 provided in another embodiment of the present application that is capable of performing cleaning operations in a variety of workplaces. The cleaning apparatus 600 includes a cleaning base 61, a manipulating shaft 62, a portable cleaner body 63, and a suction extension hose 64, wherein the portable cleaner body 63 is removable from the manipulating shaft 62.

Figure 22:
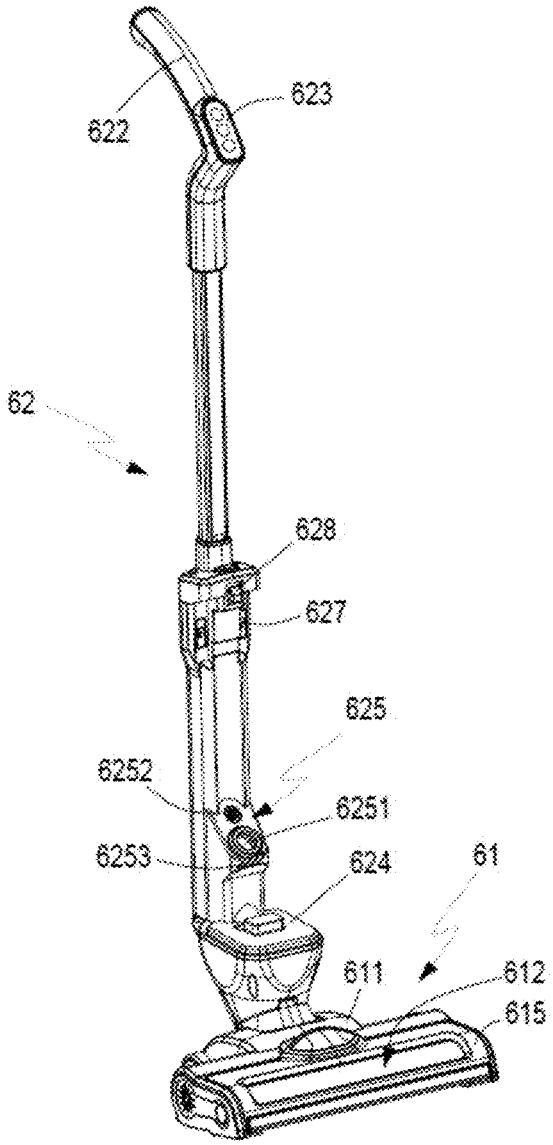
FIG. 22 illustrates a schematic view of the cleaning base and the manipulating shaft of FIG. 21.

Referring to the cleaning base 61 shown in FIG. 22, the cleaning base 61 contains a base housing 611 and a top cover 615; the base housing 611 is provided with a brush roll 612, a suction nozzle (not shown in the figure), and a cleaning fluid dispenser (not shown in the figure) at the front. The top cover 615 covers the top of the brush roll 612. With the cleaning base 61 in operation, the cleaning liquid is continuously dispensed to the brush roll 612 via the cleaning fluid dispenser, the brush roll 612 brushes the surface to be cleaned, and debris as well as dirt and fluid on the surface to be cleaned will be picked up from the surface to be cleaned by the action of the suction nozzles, or by the combined action of the suction nozzles and the brush roll 612. The brush roll 612 is driven and rotated by a brush-roll motor (not shown in the drawings) mounted at the rear of the base housing 611. The brush roll 612 in this case can rotate at hundreds of revolutions per minute or thousands of revolutions; the brush roll can be used as long as it is capable of satisfying the need to utilize a cleaning solution to rub the floor.

Continuing to refer to FIG. 22, the manipulating shaft 62 is an elongated structure and extends in a vertical direction. A lower portion of the manipulating shaft 62 is rotatably coupled to the base housing 611 of the cleaning base 61 between an upright storage position and an inclined working position. The upper portion of the manipulating shaft 62 is provided with a handle 622 for a user to grip. The handle 622 is provided with a number of control buttons 623 for controlling the operation of the cleaning apparatus 600. The manipulating shaft 62 is provided with a support platform 624 for supporting the portable cleaner body 63 at a position near the lower portion. The manipulating shaft 62 is also provided on the upper side of the support platform 624 with an engagement portion 625 that forms a two-way fluid connection between the cleaning liquid and the dirt fluid, as well as an electrical connection, with the cleaning base 61. The manipulating shaft 62 is also provided with a signal connection terminal 627 and an operable movable locking hook 628; when the portable cleaner body 63 is mounted on the manipulating shaft 62, the portable cleaner body 63 will be secured to the manipulating shaft 62 by the locking hooks 628 and the control circuitry within the portable cleaner body 63 will be signalized to the signal connection terminals 627. The engagement portion 625 will provide a first port 6251 in fluid communication with the suction nozzle of the cleaning base 61, a second port 6252 in fluid communication with the cleaning fluid dispenser of the cleaning base 61, and a first electrical connection terminal 6253 electrically conductive to the brush-roll motor of the cleaning base 61.

Figure 23:
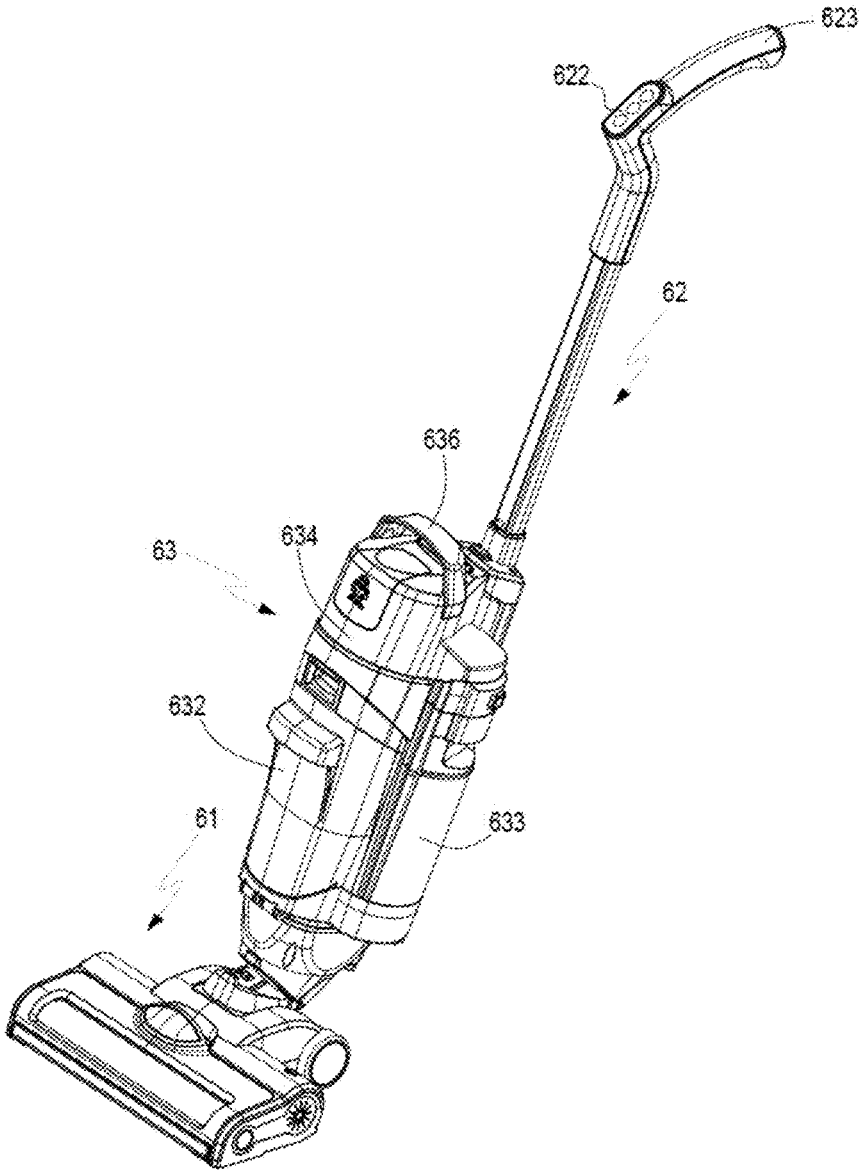
FIG. 23 illustrates a schematic view of the cleaning apparatus of FIG. 21 in the manipulating shaft operating mode.

Referring to FIGS. 21, 23, the portable cleaner body 63 is shown, which mainly includes a housing 631, a recovery tank 632 for accepting dirty liquid, a supply tank 633 for storing a cleaning liquid, a suction motor 634, and a battery pack 635. A handle 636 is provided at the top of the housing 631 for the user to carry the portable cleaner body 63, and the handle 636 has a number of control buttons 6361 at the top. The user is able to lift the portable cleaner body 63 by the handle 636. The recovery tank 632 and the supply tank 633 are both removably provided on the housing 631; a locking mechanism (not shown in the figures) capable of being operated by a user is provided between the supply tank 633 and the housing 631 and between the recovery tank 632 and the housing 631. The locking mechanism may be a mechanical locking assembly, a magnetic suction locking assembly, or both may be arranged at the same time. A lock slot 639, a signal connection terminal 638, and an engagement portion 637 are provided in the rear portion of the portable cleaner body 63 in order from top to bottom. The engagement portion 637 is capable of engaging the engagement portion 625 on the manipulating shaft 62. The engagement portion 637 provides a third port 6371 in fluid communication with the recovery tank 632, a fourth port 6372 in fluid communication with the supply tank 633, and a second electrical connection terminal 6373 electrically conductive to the battery pack 635.

Continuing with FIG. 21, the suction extension hose 64 is independent of the manipulating shaft 62 and the portable cleaner body 63. The suction extension hose 64 has a first end portion 641 and a second end portion 642 that are located away from each other in a lengthwise direction, and a flexible hose 643 that is disposed between the first end portion 641 and the second end portion 642. The first end portion 641 is constructed to be capable of both engaging a cleaning tool (e.g., the cleaning tool 65 shown in FIG. 24) that contacts the surface to be cleaned and coupling to the engagement portion 625 on the manipulating shaft 62. The second end portion 642 is constructed to be capable of adapting to the engagement portion 637. When the second end portion 642 of the suction extension tube 64 is coupled to the engagement portion 637 on the portable cleaning cleaner body 63, the first end portion 641 is allowed to fold, deform, or the like relative to the portable cleaner body 63.

The cleaning apparatus 600 of this embodiment has a plurality of modes of operation which include:

(1) A Manipulating Shaft Operating Mode

As shown in FIG. 23, the portable cleaner body 63 is mounted to the manipulating shaft 62 and locked together by the engagement of the lock hook 628 and the lock slot 639 in the manipulating shaft operating mode. The bottom of the portable cleaner body 63 will be supported on the support platform 624, and the engagement portion 625 on the manipulating shaft 62 engages the engagement portion 637 of the portable cleaner body 63. The user can hold the handle 622 to realize operating the cleaning apparatus 600 to work. The manipulating shaft 2 supported with the portable cleaner body 63 can be rotated relative to the cleaning base 61 between an upright position and an inclined working position. The suction nozzle on the cleaning base 61, the first port 6251 of the engagement portion 625, the third port 6371 of the engagement portion 637, the recovery tank 632, and the suction motor 634 will be fluidly connected in turn; and the supply tank 633, the fourth port 6372 of the engagement portion 637, the second port 6252 of the engagement portion 625, and the cleaning fluid dispenser will be fluidly connected in turn. The first electrical connection terminal 6253 is electrically connected to the second electrical connection terminal 6373. The signal connection terminal 638 is signalized to the signal connection terminal 627, which allows the user to control the operation of the apparatus via the control buttons 623.

(2) A First Hand-Held Operating Mode

Figure 24:
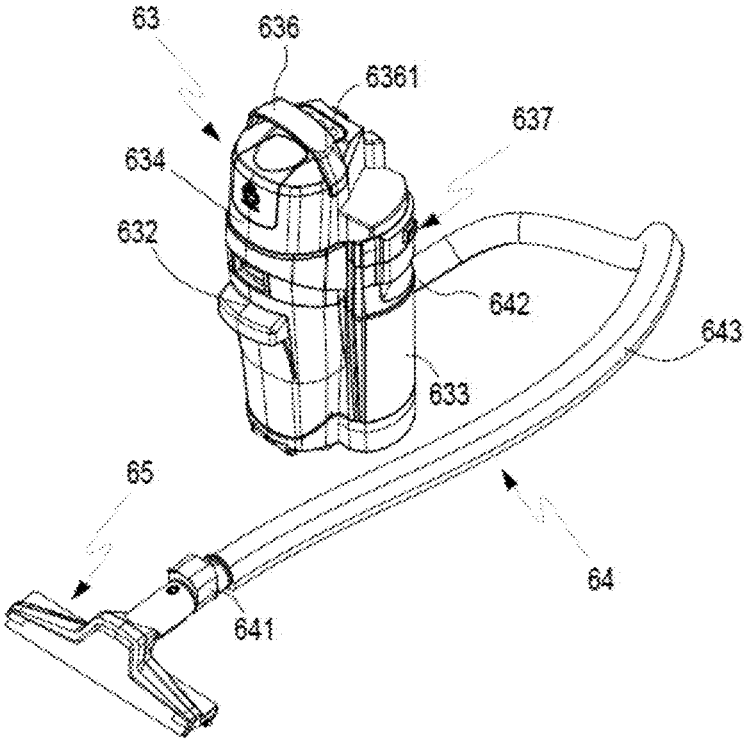
FIG. 24 illustrates a schematic view of the cleaning apparatus of FIG. 21 in the first hand-held operating mode.

As shown in FIG. 24, in the first hand-held operating mode, the portable cleaner body 63 is removed from the manipulating shaft 62, and the first end portion 641 of the suction extension hose 64 is engaged with a cleaning tool 65, and the second end portion 642 is engaged with the engagement portion 637 of the portable cleaner body 63. In this way, the portable cleaner body 63 and the cleaning tool 65 will be connected to each other by a suction extension hose 64 for cleaning fluid connectivity, dirt recovery fluid connectivity, and electrical conduction. The user can manipulate the apparatus via the control buttons 6361.

In the first hand-held operating mode, the apparatus enables cleaning of areas further away from the portable cleaner body 63, such as the ability to clean non-floor cleaning surfaces, for example table tops, window panes, and the like. The cleaning tools can be changed as needed.

(3) A Second Hand-Held Operating Mode

Figure 25:
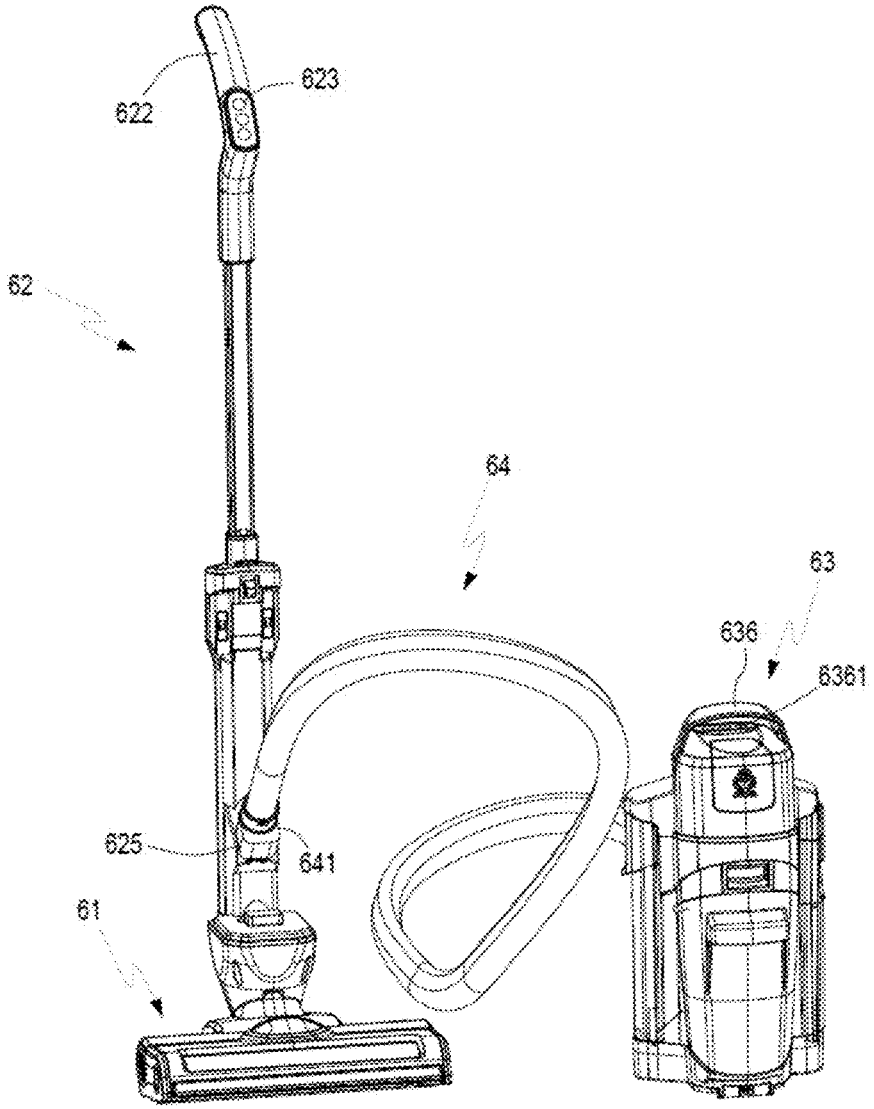
FIG. 25 illustrates a schematic view of the cleaning apparatus of FIG. 21 in the second hand-held operating mode.

As shown in FIG. 25, in the second hand-held operating mode, the portable cleaner body 63 is removed from the manipulating shaft 62, and the first end portion 641 of the suction extension hose 64 is engaged with the engagement portion 625 of the manipulating shaft 62, and the second end portion 642 is engaged with the engagement portion 637 of the portable cleaner body 63. The portable cleaner body 63 is fluidly and electrically conductive to the cleaning base 61 via the suction extension hose 64, and can also be operated to move the cleaning base 61 via the manipulating shaft 62. The suction extension hose 64 is satisfied that when the manipulating shaft 62 is rotated individually with respect to the cleaning base 61, the fluid connection and electrical conduction between the manipulating shaft 62 and the portable cleaner body 63 are not affected. At this time, the user can rotate the manipulating shaft 62 backward at will, or even rotate it to a position that is close to the floor to be cleaned, which can be beneficial to the user to extend the cleaning base 61 into a low place (e.g., at the bottom of a sofa, under a low table) for cleaning; and because the recovery tank 632 has been detached from the manipulating shaft 62, the backward rotation of the manipulating shaft 62 will not cause the dirt liquid in the recovery tank 632 to back up into the suction motor 634, ensuring the safety of the use of the suction motor 634. The portable cleaner body 63 in this case can either be placed directly on the floor to be cleaned or can be carried by the user holding the handle 636 in the other hand.

The second hand-held operating mode is suitable for cleaning low surfaces to be cleaned, such as the floor under the bed, the bottom of the table, etc., as well as the stairs and other areas. When the apparatus is in operation, the cleaning liquid in the supply tank 633 is continuously supplied to the brush roll 612, and the brush roll 612 wetted by the cleaning fluid rotates under the drive of the brush-roll motor, continuously rubbing against the surface to be cleaned, thereby realizing the cleaning of the surface to be cleaned. At the same time, under the action of the suction motor 634, the dirty liquid and debris on the surface to be cleaned and the dirt liquid thrown off from the rotating brush roll 612 are sucked in together with the suction nozzle and sent to the recovery tank 632, the dirt liquid and debris remain in the recovery tank 632, and the clean air is discharged to the outside world after the suction motor 634.

The above shows and describes the basic principles of the present invention, the main features and the advantages of the present invention. Those skilled in the art should understand that the present invention is not limited by the above embodiments, and that the above embodiments and the description in the specification are only illustrative of the principles of the present invention, and that there will be various changes and improvements to the present invention without departing from the spirit and scope of the present invention, and that the scope of protection claimed for the present invention is defined by the appended claims, the specification, and the equivalents thereof.

The invention claimed is:

1. A cleaning apparatus, comprising:

a cleaning base comprising a brush roll capable of contacting a surface to be cleaned, a cleaning fluid dispenser for dispensing cleaning fluid to the brush roll and/or the surface to be cleaned, a suction nozzle and a brush-roll motor for driving the brush roll in rotation;

a manipulating shaft, a lower portion of which is rotatably coupled to the cleaning base, an upper portion of the manipulating shaft is provided with a first handle, the manipulating shaft including a first engagement portion provided with a first port in fluid communication with the suction nozzle, a second port in fluid communication with the cleaning solution dispenser, and a first electrical connection terminal in electrical communication with the brush-roll motor;

a portable cleaner body removably installed on the manipulating shaft and including a supply tank for storing cleaning liquid, a recovery tank for storing dirty liquid, a suction motor in fluid connection with the recovery tank, a second handle for the user to carry the portable cleaner body, a battery pack, and a second engagement portion providing a third port in fluid communication with the recovery tank, a fourth port in fluid communication with the supply tank, and a second electrical connection terminal in electrical conduction with the battery pack; wherein the second engagement portion is configured to be capable of coupling with the first engagement portion to fluidly connect the third port to the first port, the fourth port to the second port, and the second electrical connection terminal to the first electrical connection terminal; and a suction extension hose set independently of the manipulating shaft and the portable cleaner body and having a first end portion and a second end portion positioned on opposite ends in the length direction, and the suction extension hose providing a first fluid pathway, a second fluid pathway, and an electrical circuit located between the first end portion and the second end portion; wherein the second end portion is constructed to be capable of coupling with the second engagement portion to electrically connect the first fluid pathway to the third port fluidly, the second fluid pathway to the fourth port fluidly, and the electrical circuit to the second electrical connection terminal;

wherein the portable cleaner body includes a housing, the recovery tank and the supply tank are both removably mounted to the housing, the recovery tank is located directly below the suction motor;

wherein the portable cleaner body also includes a pump for outputting cleaning fluid from the supply tank outwardly;

wherein the first handle is provided with a first control component for user operation, the second handle is provided with a second control component for user operation, the first control component has a first control button and a second control button for controlling the operation of the suction motor and the pump when the portable cleaner body is supported on the manipulating shaft, and the second control component has a third control button for controlling the operation of the suction motor when the portable cleaner body is removed from the manipulating shaft; and wherein the suction extension hose has a fourth control button for controlling the operation of the pump when the second end portion is coupled with the second engagement portion.

2. The cleaning apparatus of claim 1, wherein the portable cleaner body is removably supported on the front side of the manipulating shaft.

3. The cleaning apparatus of claim 1, wherein the manipulating shaft comprises a sloped surface; the first port, the second port, and the first electrical connection terminal distributed on the sloped surface.

4. The cleaning apparatus of claim 3, wherein the first electrical connection terminal, the second port, and the first port are distributed from top to bottom.

5. The cleaning apparatus of claim 1, wherein the recovery tank has a bottom end, a top end opposite to the bottom end, and a side wall extending from the bottom end toward the top end, an interior of the recovery tank defined by the recovery chamber having an inlet tube leading to the chamber, the inlet tube inclined to a vertical plane having a lower port located on the side wall and an upper port extending into the chamber, and the third port is in fluid communication with or defined by the lower port.

6. The cleaning apparatus of claim 5, wherein the side wall has a recessed portion, and the lower port is located at the recessed portion.

7. The cleaning apparatus of claim 1, wherein the supply tank and the battery pack are located on the left and right sides of the recovery tank, respectively.

8. The cleaning apparatus of claim 7, wherein the second handle is fixedly provided on the top of the housing.

9. The cleaning apparatus of claim 7, wherein the portable cleaner body includes a receiving cavity provided in the housing to receive the recovery tank, and the receiving cavity has a front portion with an opening to enable the recovery tank to be placed into the receiving cavity from the front.

10. The cleaning apparatus of claim 9, wherein the housing has a bottom wall and a vertical wall extending upwardly from the bottom wall, and the receiving cavity is at least partially defined by the vertical wall and the bottom wall.

11. The cleaning apparatus of claim 10, wherein the housing has an exhaust hole in fluid communication with the suction motor, and the exhaust hole is located on the vertical wall and in fluid communication with the receiving cavity.

12. The cleaning apparatus of claim 10, wherein the bottom wall has a first support portion and a second support portion located on the right and left sides of the vertical wall, one part of the supply tank and the battery pack is provided on the first support portion and the other part is provided on the second support portion.

13. The cleaning apparatus of claim 1, wherein the first end portion has an outer end surface configured to seal against a flat surface, an interior of the first end portion defines a first chamber and a second chamber, the first chamber and the second chamber are in fluid communication with each other, the first chamber has an opening located in the outer wall of the first end portion that allows outside air to flow into the first chamber, the first fluid pathway has a fluid connection provided at the first end and located within the first chamber, and the second fluid pathway has an airflow connection provided at the first end and located within the second chamber.

14. The cleaning apparatus of claim 13, wherein an interior of the first end portion has an axially extending wall, the first chamber and the second chamber are disposed on opposite sides of the wall, the wall has a top surface disposed inwardly of the outer end surface, a notch is defined between the top surface and the outer end surface, and the first chamber and the second chamber are fluidly connected via the notch.

15. The cleaning apparatus of claim 1, further comprising: a plurality of cleaning tools adapted to contact the surface to be cleaned, wherein the plurality of cleaning tools are configured to be capable of coupling with the first end of the suction extension hose.

16. The cleaning apparatus of claim 15, comprising a plurality of modes of operation, the plurality of modes of operation comprising:

a manipulating shaft operating mode in which the portable cleaner body is mounted to the manipulating shaft, and the first engagement portion coupled to the second engagement portion; and a first hand-held operating mode in which the portable cleaner body is detached from the manipulating shaft, the second end portion of the suction extension hose is coupled to the second engagement portion, and the first end portion of the suction extension hose is coupled to one of the cleaning tools.

17. The cleaning apparatus of claim 16, wherein the first end portion is constructed to be adapted to the first engagement portion and the plurality of modes of operation further comprising: a second hand-held operating mode in which the portable cleaner body is removed from the manipulating shaft, the second end portion of the suction extension hose is coupled to the second engagement portion, and the first end portion of the suction extension hose is engaged with the first engagement portion.

* * * * *